US006488598B2

(12) United States Patent
Porter

(10) Patent No.: US 6,488,598 B2
(45) Date of Patent: Dec. 3, 2002

(54) BASKETBALL SPINNER

(76) Inventor: David Lee Porter, 1500 South Beaverhill Rd., Birchrunville, PA (US) 19425-0135

( * ) Notice: Subject to any disclaimer, the term of this patent is extended or adjusted under 35 U.S.C. 154(b) by 0 days.

(21) Appl. No.: 09/873,528

(22) Filed: Jun. 4, 2001

(65) Prior Publication Data

US 2002/0010040 A1 Jan. 24, 2002

Related U.S. Application Data

(60) Provisional application No. 60/209,353, filed on Jun. 5, 2000.

(51) Int. Cl.[7] ..... A63B 69/00; A63B 67/06
(52) U.S. Cl. ..... 473/450; 473/422
(58) Field of Search ..... 473/450

(56) References Cited

U.S. PATENT DOCUMENTS 490,733 A * 1/1893 Armat
911,838 A * 2/1909 Napier
2,536,979 A * 1/1951 Furedi
3,673,731 A * 7/1972 Farhi et al.
3,975,016 A * 8/1976 Bodor
4,040,625 A * 8/1977 Malafronte
4,096,659 A * 6/1978 Keane
4,149,661 A * 4/1979 Curtiss
4,889,347 A * 12/1989 Mineart
D316,931 S * 5/1991 Joy
5,067,923 A * 11/1991 de Bourdon
5,261,851 A * 11/1993 Siebert, Jr.
5,318,293 A * 6/1994 Nathanson et al.
5,577,272 A * 11/1996 Fisher
D383,517 S * 9/1997 Davlin et al.
5,833,233 A * 11/1998 Strug
5,839,983 A * 11/1998 Kramer

* cited by examiner

*Primary Examiner*—Paul T. Sewell
*Assistant Examiner*—Nini F. Legesse
(74) *Attorney, Agent, or Firm*—Tom Hamill, Jr.

(57) ABSTRACT

The invention includes a concave cup specifically designed to hold various size basketballs. The cup has a stem which inserts and is held securely in a precision bearing, which in turn is held firmly in the splined finger gripping portion of the invention. The splined finger gripping portion of the device is held securely on the finger of a person, by an o-ring. The o-ring rolls up and down on the splined portion and is prevented from rolling off by the molded protrusions at the bottom of the splined finger gripping portion of the invention. The splines are tapered to allow for expansion and contraction to fit various finger sizes.

1 Claim, 3 Drawing Sheets

Fig. 5
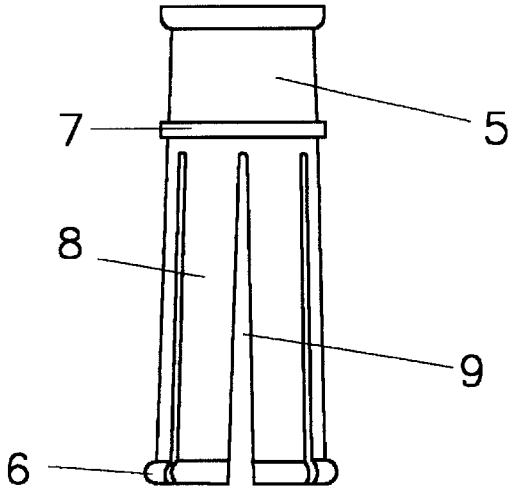
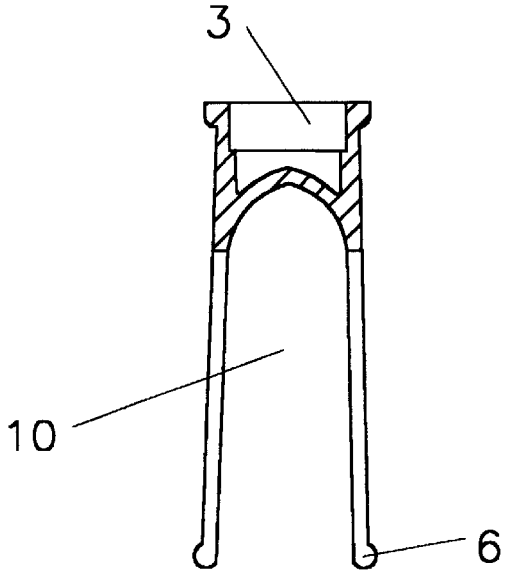
Fig. 6
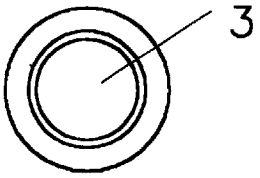
Fig. 7
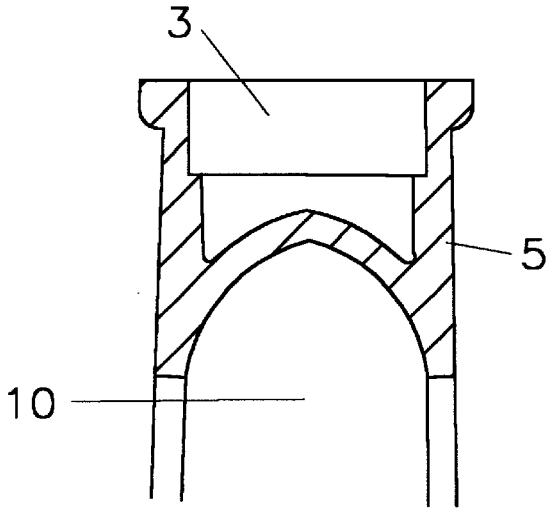
Fig. 8

BASKETBALL SPINNER

CROSS-REFERENCE TO RELATED APPLICATIONS

This application claims benefit of provisional appln. Ser. No. 60/209,353 filed Jun. 5, 2000.

References Cited, U.S. PATENT DOCUMENTS.

| | | | |
|---|---|---|---|
| 5,318,293 | 6/94 | Nathanson, Caporale, Zoltner. | Appl. No. 62,299 |
| 5,067,923 | 11/91 | Bourbon. | Appl. No. 499,002 |
| 5,125,862 | 6/92 | Paranto. | Appl. No. 732,811 |
| 4,040,625 | 8/77 | Malafronte. | Appl. No. 761,818 |
| 5,181,876 | 1/93 | Chen. | Appl. No. 845,235 |
| 5,261,851 | 11/93 | Siebert | Appl. No. 955,124 |

STATEMENT REGARDING FEDERALLY SPONSORED RESEARCH OR DEVELOPMENT

None.

BACKGROUND OF THE INVENTION

The present invention is a toy, it relates to a ball spinning apparatus for the amusement and training of the user in the skill of spinning a basketball on one finger. Before this invention most products were dangerous, because of sharp pointed parts to pierce a ball, or were not specifically intended to use a real basketball for the development of the basketball spinning skill.

BRIEF SUMMARY OF THE INVENTION

The general idea of the Basketball Spinner, is an apparatus that is placed over one finger of either hand of the user. A basketball of any size is then placed in the ball-holding portion of the device. The ball is then lightly struck on its side causing it to begin rotating.

The combination of a firm holding device on the finger,a specially designed ball holding portion, and a precision bearing at the tip of the finger gripping device, enable anyone to spin a basketball on one finger, smoothly and for an indefinite amount of time, with the aid of the device.

BRIEF DESCRIPTION OF THE DRAWINGS

The present invention will be more fully understood by references to the following detailed description thereof when read in conjunction with the attached drawings, and wherein:

FIG. 5 is a side view of the splined finger gripping portion of the invention.

FIG. 6 is a sectional view of the splined finger gripping portion of the invention.

FIG. 7 is a top view of the splined finger gripping portion of the invention.

FIG. 8 is an enlarged view of the upper portion of the splined finger gripping portion of the invention.

DETAILED DESCRIPTION OF THE INVENTION

Figure 1:
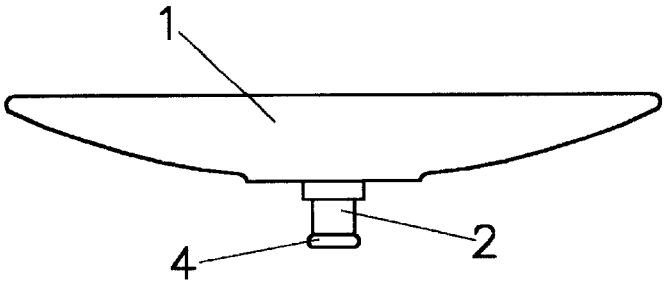
FIG. 1 is a side view of the ball holding cup.
Figure 2:
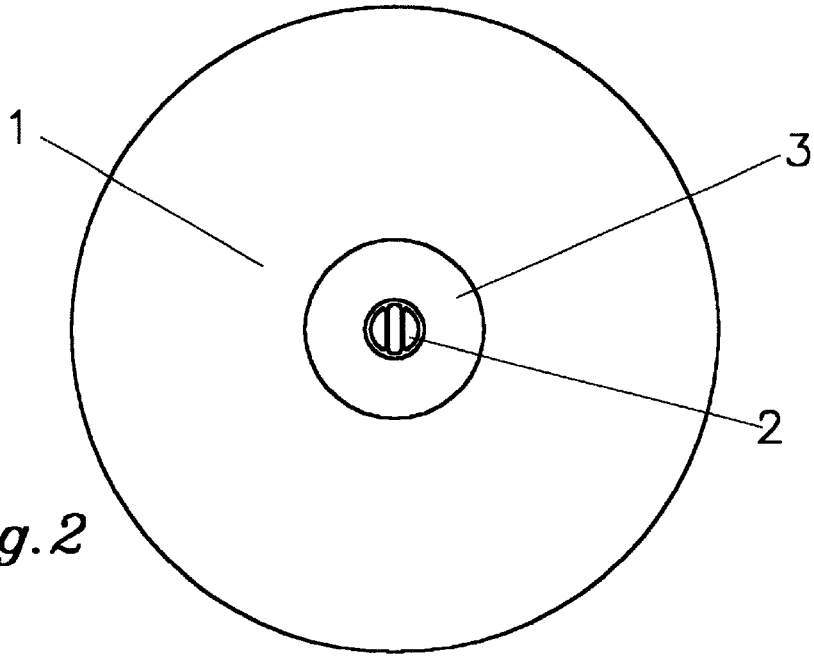
FIG. 2 is a bottom view of the ball holding cup.
Figure 3:
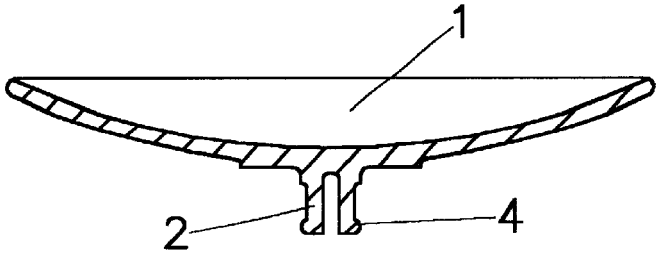
FIG. 3 is a sectional view of the ball holding cup.
Figure 4:
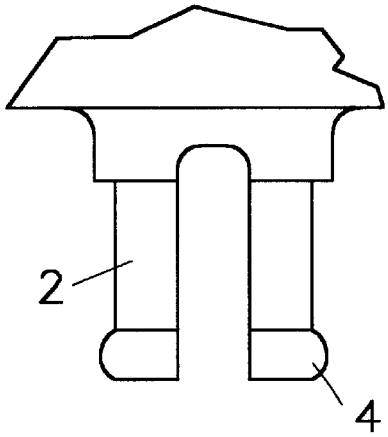
FIG. 4 is an enlarged view of the ball holding cup stem.
Figure 9:
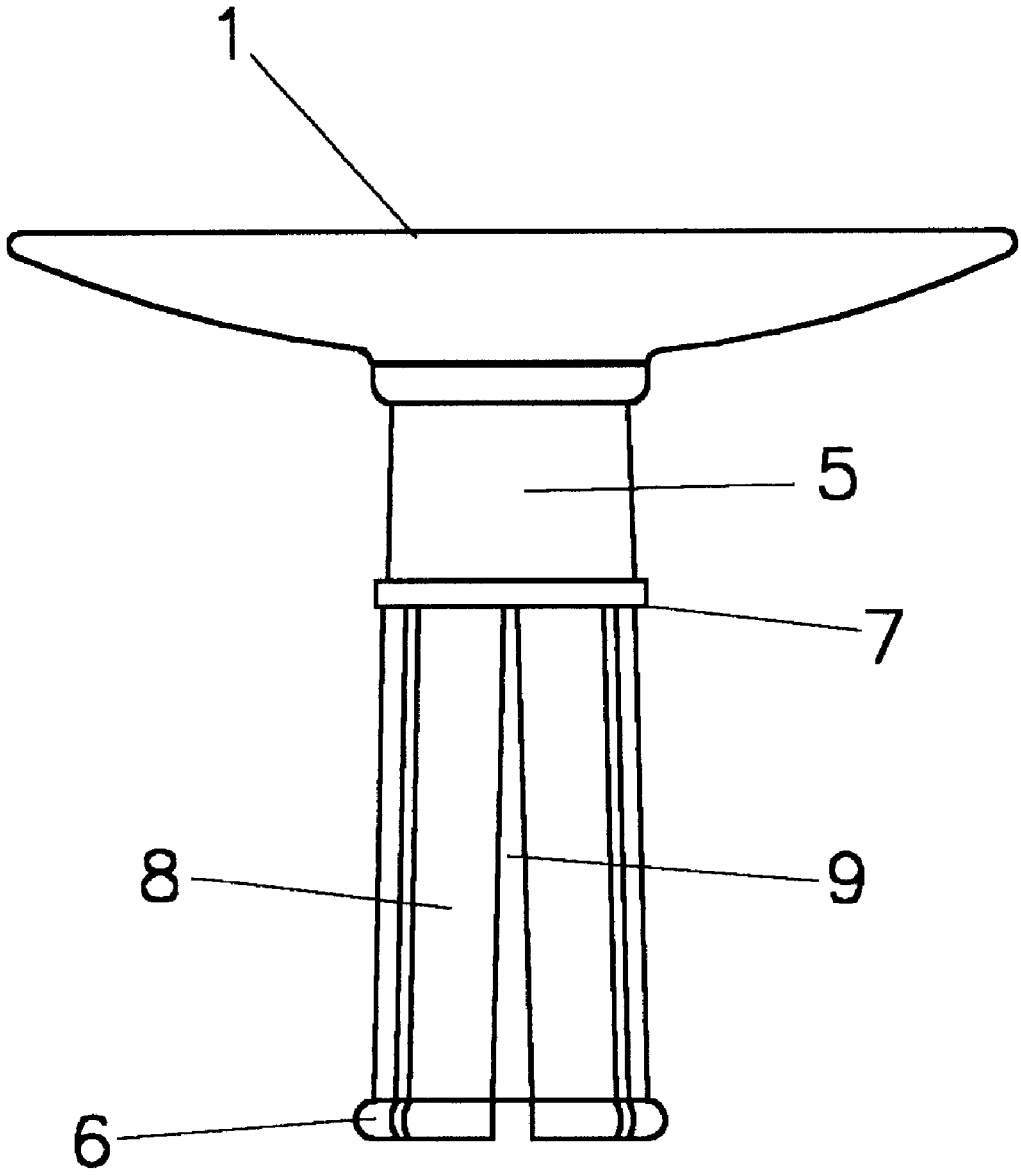
FIG. 9 is an illustration of the basketball spinning device in full view.

FIG. 1 The ball spinning device includes a ball holding cup 1 designed specifically to hold any size basketball, NBA, WNBA, street, or pee-wee. The basketball fits perfectly in the cup 1. The stem 2 of the cup 1 is designed to be inserted into a precision bearing 3, and onec fully inserted the tab 4 at the bottom of the stem 2, holds the cup 1, tightly in place on the precision bearing 3. The ball holding cup 1 is made of plastic from an injection molding process. FIG. 2 shows a bottom view of the ball cup 1, with the stem 2, inserted into the precision bearing 3. The precision bearing will be supplied by a precision bearing manufacturer. FIG. 3 is a sectional drawing of the ball cup 1, stem 2, and tab 4. FIG. 4 is an enlarged view of the ball cup 1, stem 2, and tab 4. FIG. 5 Illustrates the splined finger gripping, bearing holding, portion 5 of the basketball spinning device side view, the protrusions 6, located at the bottom of the splined finger grippers 8, stop the O-ring 7, which is movable, it rolls up and down, and holds the splined finger gripping portion 8, tightly to the user's finger. The splined finger grippers 8, are each tapered 9, to allow for contraction and expansion to fit various size fingers. FIG. 6 is a sectional view of the finger gripping portion 5, showing the area where the finger is held 10, and the area where the precision bearing 3, is held, the protrusions 6, are also shown in this view. FIG. 7 shows the top view of the finger gripping device 5, and where the precision bearing 3 is held. FIG. 8 is an enlarged view of the finger gripping device 5, and the finger area 10, also the precision bearing 3, area. FIG. 9 shows a side view of the entire unit, ball holding cup 1, finger gripping portion 5, protrusions 6, to stop O-ring 7, from being moved down too far. Splines 8, are tapered 9.

What is claimed is:

1. A device used to balance and spin a ball on one finger comprising, a cavity, said cavity comprised of a plurality of tapered splines, said splines to allow said cavity to receive a finger of any size therein, said splines including a bottom, a stem, said stem connected atop said cavity, said stem including a bearing thereon, a cup, an o-ring, said o-ring able to be rolled down over said splines, causing said splines to be tightened about the finger, said bottom of said splines including a protrusion, said protrusion preventing said o-ring from leaving said device whereby a finger is placed in said cavity, said o-ring is rolled down tightly securing said cavity to the finger, the ball is placed on said cup, and said ball is rotated.

* * * * *